US009195248B2

(12) United States Patent
Zegheru et al.

(10) Patent No.: US 9,195,248 B2
(45) Date of Patent: Nov. 24, 2015

(54) FAST TRANSIENT RESPONSE VOLTAGE REGULATOR

(71) Applicant: Infineon Technologies AG, Neubiberg (DE)

(72) Inventors: Cristian Stefan Zegheru, Bucharest (RO); Liviu-Mihai Radoias, Ploiesti (RO)

(73) Assignee: Infineon Technologies AG, Neubiberg (DE)

( * ) Notice: Subject to any disclaimer, the term of this patent is extended or adjusted under 35 U.S.C. 154(b) by 153 days.

(21) Appl. No.: 14/134,901

(22) Filed: Dec. 19, 2013

(65) Prior Publication Data

US 2015/0177753 A1 Jun. 25, 2015

(51) Int. Cl.
*G05F 1/00* (2006.01)
*G05F 1/46* (2006.01)

(52) U.S. Cl.
CPC ..... *G05F 1/468* (2013.01)

(58) Field of Classification Search
CPC ..... G05F 1/468
USPC ..... 323/268, 269, 273
See application file for complete search history.

(56) References Cited

U.S. PATENT DOCUMENTS

| | | | | |
|---|---|---|---|---|
| 4,672,235 | A * | 6/1987 | Villa et al. | 327/485 |
| 4,791,349 | A * | 12/1988 | Minks | 323/273 |
| 6,304,131 | B1 | 10/2001 | Huggins et al. | |
| 6,677,735 | B2 | 1/2004 | Xi | |
| 6,703,815 | B2 | 3/2004 | Biagi | |
| 6,825,641 | B2 * | 11/2004 | Pigott | 323/272 |
| 6,856,124 | B2 | 2/2005 | Dearn et al. | |
| 6,861,827 | B1 * | 3/2005 | Yang et al. | 323/273 |
| 6,897,715 | B2 | 5/2005 | Barber, Jr. et al. | |
| 7,327,125 | B2 | 2/2008 | Benbrik | |
| 7,585,719 | B2 | 9/2009 | Balakrishnan | |
| 7,656,139 | B2 * | 2/2010 | van Ettinger | 323/280 |
| 7,679,437 | B2 | 3/2010 | Tadeparthy et al. | |
| 7,710,091 | B2 | 5/2010 | Huang | |
| 7,821,240 | B2 | 10/2010 | Oddoart et al. | |
| 2004/0000896 | A1 | 1/2004 | Barber, Jr. et al. | |
| 2006/0273771 | A1 | 12/2006 | van Ettinger et al. | |
| 2008/0024012 | A1 | 1/2008 | Qahouq et al. | |
| 2009/0033298 | A1 * | 2/2009 | Kleveland | 323/273 |
| 2011/0291627 | A1 | 12/2011 | Zegheru et al. | |
| 2012/0262135 | A1 | 10/2012 | Childs | |
| 2013/0169247 | A1 * | 7/2013 | Onouchi et al. | 323/269 |

FOREIGN PATENT DOCUMENTS

WO 2013013957 A1 1/2013

OTHER PUBLICATIONS

Subrato Roy, "Design technique for best transient load regulation in linear voltage regulators", OMAP—Analog Texas Instruments, May 2013, 5 pp.

* cited by examiner

*Primary Examiner* — Jue Zhang
(74) *Attorney, Agent, or Firm* — Shumaker & Sieffert, P.A.

(57) ABSTRACT

Techniques are described for adjusting an amount of current flowing through a first and second transistor of a voltage regulator connected to an output of a voltage regulator to maintain an output of the voltage regulator at a constant output voltage level. Also, a resistor connects a gate of the first transistor to a gate of a second transistor. The techniques may also charge or discharge a parasitic capacitance of the first transistor with a first current source connected to the gate of the first transistor and a second current source connected to the gate of the first transistor through the resistor.

20 Claims, 5 Drawing Sheets

FAST TRANSIENT RESPONSE VOLTAGE REGULATOR

TECHNICAL FIELD

This disclosure is related to voltage regulators, and more particularly, to voltage regulators with fast transient response.

BACKGROUND

Voltage regulators are designed to maintain an output voltage at a constant voltage level over a range of output impedance. If there is a change in the output or input (e.g., a change in the load driven by the voltage regulator or change in the source voltage), the voltage regulator corrects for the change to maintain the output voltage at the constant voltage level. For example, if there is a sudden change in the amount of current that needs to be delivered by the voltage regulator due to a change in the load impedance, the output voltage level of the voltage regulator may temporarily deviate from the constant output voltage level until the voltage regulator corrects for the change in the load impedance and outputs a voltage at the constant voltage level.

SUMMARY

In general, the disclosure describes techniques for a voltage regulator with fast transient response time that reduces overshoot in the output voltage during the transient response time by driving transistors in a power stage of the voltage regulator with separate current sources. Transient response time refers to the amount of time it takes the voltage regulator to compensate for a change in output so as to maintain a constant voltage level. One factor that affects the transient response time of the voltage regulator is the parasitic capacitance of transistors within a power stage of the voltage regulator.

The techniques described in this disclosure may minimize the parasitic capacitance of the transistors within a power stage of the voltage regulator that a driver of the voltage regulator needs to initially charge or discharge, in response to a change in the amount of current that needs to be delivered. For instance, initially, the driver may predominately charge or discharge the parasitic capacitance of the smallest transistor within the power stage (e.g., charge or discharge the parasitic capacitance of the smallest transistor the fastest from among all of the transistors in the power stage). Then, overtime, the driver may charge or discharge the parasitic capacitance of the other transistors. Furthermore, by charging and discharging transistors with separate current sources, the techniques may ensure that the parasitic capacitances of the transistors are charged and discharged timely so as to minimize the output voltage overshoot when compensating for a change in the amount of current that needs to be delivered.

In one example, the disclosure is directed to a voltage regulator comprising a first transistor and a second transistor, wherein the first transistor and the second transistor are connected to a power source of the voltage regulator and an output of the voltage regulator, and wherein the first transistor and the second transistor deliver an amount of current needed to maintain the output of the voltage regulator at a constant output voltage level, a resistor that connects a gate of the first transistor to a gate of the second transistor, and a first current source and a second current source, wherein the first current source is configured to drive the gate of the first transistor and the gate of the second transistor through the resistor, and wherein the second current source is configured to drive the gate of the second transistor and the gate of the first transistor through the resistor.

In another example, the disclosure is directed to a method comprising in response to a change in an amount of current that needs to be delivered by a voltage regulator, adjusting an amount of current flowing through a first transistor and a second transistor of the voltage regulator to maintain an output of the voltage regulator at a constant output voltage level, wherein the first transistor and second transistor are connected to a power source of the voltage regulator and to the output of the voltage regulator, and wherein a resistor of the voltage regulator connects a gate of the first transistor to a gate of the second transistor, and in response to the change in the amount of current that needs to be delivered by the voltage regulator, charging or discharging a parasitic capacitance of the first transistor with a first current source connected to the gate of the first transistor and a second current source connected to the gate of the first transistor through the resistor.

In another example, the disclosure is directed to a voltage regulator comprising in response to a change in an amount of current that needs to be delivered by the voltage regulator, means for adjusting an amount of current flowing through a first transistor and a second transistor of the voltage regulator to maintain an output of the voltage regulator at a constant output voltage level, wherein the first transistor and second transistor are connected to a power source of the voltage regulator and to the output of the voltage regulator, and wherein a resistor of the voltage regulator connects a gate of the first transistor to a gate of the second transistor, and in response to the change in the amount of current that needs to be delivered by the voltage regulator, means for charging or discharging a parasitic capacitance of the first transistor with a first current source connected to the gate of the first transistor and a second current source connected to the gate of the first transistor through the resistor.

The details of one or more examples described in this disclosure are set forth in the accompanying drawings and the description below. Other features, objects, and advantages of the techniques will be apparent from the description and drawings, and from the claims.

DETAILED DESCRIPTION

Figure 1:
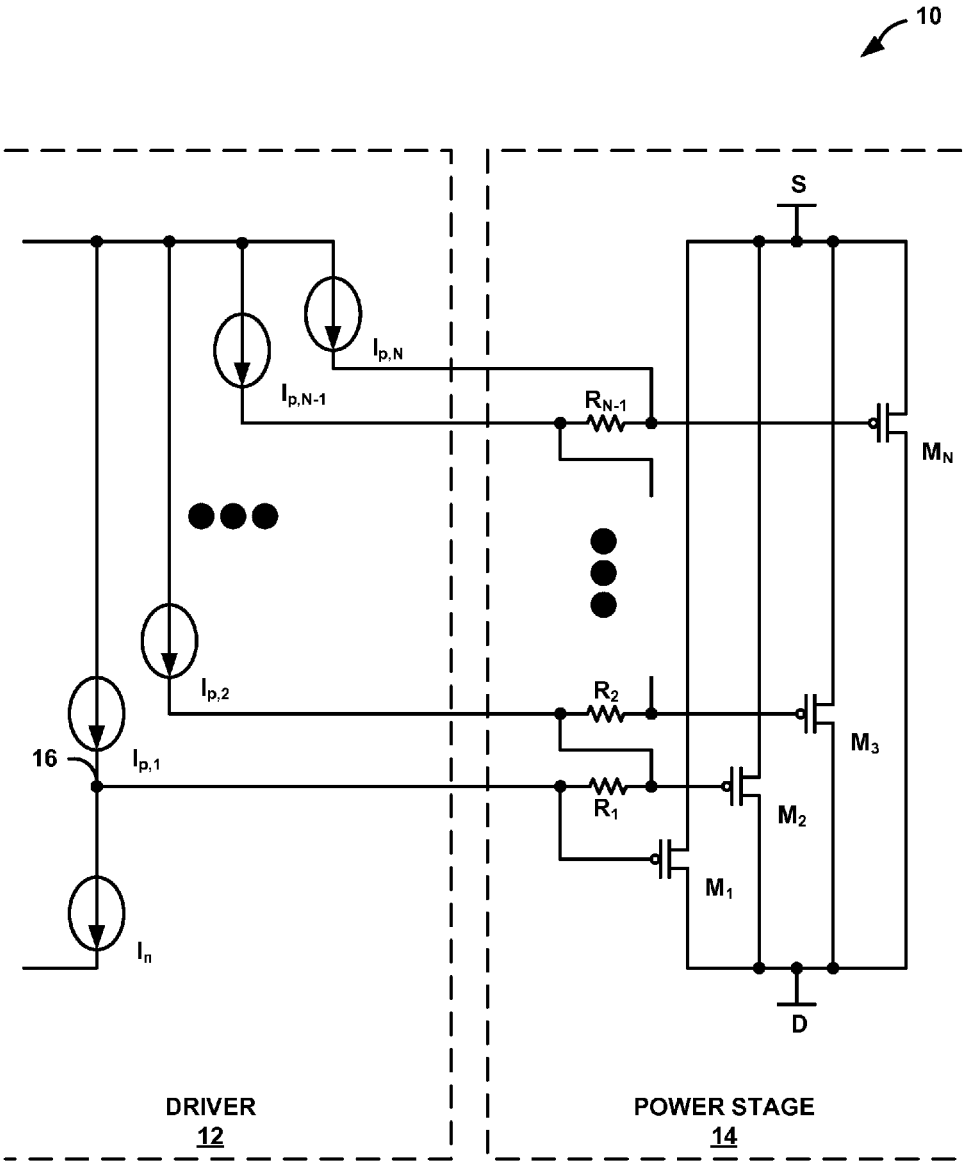
FIG. 1 is a conceptual block diagram illustrating an example portion of a voltage regulator that includes a driver and a power stage, in accordance with the techniques described in this disclosure.

Techniques described in this disclosure are related to voltage regulators that are configured to output a voltage at a constant output voltage level over a range of load impedances. A voltage regulator may be formed within an integrated circuit (IC) and coupled to a circuit board. The voltage regulator may receive as input a reference voltage from a reference voltage source and may output a voltage proportional to the input reference voltage, and in many cases, equal to the input reference voltage. However, while the reference voltage source may not be configured to maintain the same output voltage level over a range of load impedances (e.g., the reference voltage level is a function of the load impedance), the voltage regulator may maintain the same output voltage level over a range of load impedances (e.g., the output voltage level is not a function of the load impedance).

For example, if an impedance of a load connected to the output of the voltage regulator is at a first impedance level or at a second impedance level, the output voltage of the voltage regulator is at the same voltage level. To keep the output voltage at the same level for a range of load impedances, the voltage regulator may be configured to deliver current over a range of current levels. For instance, assume the output voltage of the voltage regulator is 5 volts (V). In this is example, if the impedance of the load is 1 kOhms, the voltage regulator may deliver 5 milliamps (mA) of current, but if the impedance of the load is 10 kOhms, the voltage regulator may deliver 0.5 mA of current.

In some examples, the amount of current that the voltage regulator needs to deliver may change, and in some cases, suddenly change. For example, the voltage regulator may be connected to a plurality of loads, and one of the loads may become disconnected causing a change in the amount of current the voltage regulator needs to deliver. The change in the amount of current that the voltage regulator needs to deliver may cause the output voltage to deviate from the constant output voltage level. To stabilize the output voltage back to the constant output voltage level, the voltage regulator may also receive the output voltage or a voltage proportional to the output voltage as feedback voltage. The voltage regulator may compare the feedback voltage with the reference voltage and adjust currents of the voltage regulator so that the output voltage stabilizes back to the constant output voltage level.

The time it takes the voltage regulator to stabilize the output voltage back to the constant output voltage level is referred to as a transient response time. In general, it is preferable to stabilize to the output voltage back to the constant output voltage level relatively quickly (i.e., have a fast transient response time). As one example, a transient response time of less than 300 micro-seconds (us) may be desirable. However, while a fast transient response time may be desirable, it may also be desirable to minimize the overshoot and the undershoot of the output voltage during the transient response time, as well as minimizing a quiescent current of the voltage regulator and minimizing a size of a capacitor connected to the output of the voltage regulator.

In some examples, the output of the voltage regulator is connected to a capacitor, and the capacitor delivers the current during the transient response time. If the capacitance of the capacitor is relatively large, a longer transient response time can be tolerated because the capacitor will be able to deliver the current for a longer period of time as compared to if the capacitance of the capacitor is relatively small. However, capacitors with relatively large capacitance are generally larger in size, and having relatively large sized capacitors increases cost and utilizes additional area on the circuit board, which may be undesirable.

Quiescent current refers to the amount of current the voltage regulator consumes when no load is connected to the voltage regulator. For example, if the voltage regulator is powered and no load is connected to the voltage regulator, the amount of current that the voltage regulator consumes is referred to as the quiescent current. The quiescent current may be relatively small (e.g., in the order of a few micro-amps (uA)). In other words, quiescent current is the amount of current the voltage regulator consumes when the voltage regulator is not delivering any current.

To reduce the transient response time, some techniques propose increasing the quiescent current. However, increasing the quiescent current may be undesirable because it reduces the lifetime of the battery (e.g., the battery discharges more quickly having to deliver the higher quiescent current level).

This disclosure describes a voltage regulator that provides a fast transient response time, while minimizing voltage undershoots and overshoots. In addition, this disclosure describes techniques for the fast transient response time with minimal voltage overshoot and undershoot, which do not require an increase in the quiescent current or an increase in the capacitance of the capacitor connected to the output of the voltage regulator.

As described in more detail, a voltage regulator includes two portions: a driver and a power stage. In the techniques described in this disclosure, the power stage includes a plurality of different sized transistors that are connected to the output of the voltage regulator. The gates of each of the transistors may be connected to the gate of another transistor through one or more resistors. For example, the gate of a first transistor may be connected to the gate of a second transistor through a first resistor, and the gate of the second transistor may be connected to the gate of a third transistor through a second resistor. In this example, the gate of the first transistor is connected to the gate of the second transistor through one resistor (e.g., the first resistor), the gate of the second transistor is connected to the gate of the third transistor through one resistor (e.g., the second resistor), and the gate of the first transistor is connected to the gate of the third transistor through two resistors (e.g., the first and second resistors).

By connecting the gates of the transistors of the power stage via one or more resistors, the resistors may be considered as decoupling the transistors from one another. The decoupling of the transistors from one another with the resistors may minimize the amount of parasitic capacitance that the driver needs to initially charge or discharge in response to a change in the amount of current the voltage regulator needs to deliver.

The parasitic capacitance of a transistor is one of the factors that affects the transient response time. One example of the parasitic capacitance is the gate-source capacitance of a transistor. To stabilize the output voltage back to the constant voltage output level, the driver of the voltage regulator may charge or discharge the parasitic capacitance, which takes time. The charge or discharge rate of the parasitic capacitance is a factor of the amount of capacitance provided by the parasitic capacitance, and the amount of capacitance provided by the parasitic capacitance is a factor of the size of the transistor.

Hence, the charge or discharge rate of the parasitic capacitance of a transistor is a factor of the size of the transistor. Also, because the gates of the transistors are connected to respective resistors, the charge or discharge rate of the parasitic capacitance of a transistor is also based on the resistors connected in series to the gates of respective transistors.

In the techniques described in this disclosure, the driver of the voltage regulator may directly drive the gate of the first, smallest transistor (e.g., there may be no resistor or a resistor with minimal resistance connected to the gate of the smallest transistor). However, it may be possible for the driver to drive the gate of the first, smallest transistor through a resistor. The driver of the voltage regulator may drive the gate of the second, next smallest transistor through the resistor connected to the gate of the second transistor. The driver of the voltage regulator may drive the gate of the third, next smallest transistor through the resistor connected to the gate of the third transistor, and so forth.

For example, the driver of the voltage regulator outputs current to the transistors of the power stage of the voltage regulator. In this way, if there is a change in the amount of current the voltage regulator needs to deliver, then, initially, the driver may be able to charge or discharge the parasitic capacitance of the first transistor relatively quickly because the first transistor is the smallest sized transistor and therefore has the least parasitic capacitance. Charging or discharging the parasitic capacitance of the first transistor relatively quickly allows the amount of current flowing through the first transistor to the output of the voltage regulator to change relatively quickly for fast stabilization the output voltage to the constant output voltage level.

In the techniques described in this disclosure, the parasitic capacitance of the transistors other than the first transistor may not initially contribute or may contribute minimally to the overall parasitic capacitance because of the connection of the gates of the transistors to one another via one or more resistors. For example, the parasitic capacitance of the second, next smallest transistor may be greater than the parasitic capacitance of the first, smallest transistor. However, initially, the parasitic capacitance of the second, next smallest transistor may not contribute or contribute minimally to the overall parasitic capacitance (e.g., add to the parasitic capacitance of the first, smallest transistor) because the resistor connected between the gates of the first and second transistors decouples the parasitic capacitance at least initially.

Over time, the parasitic capacitance from each successive transistor may contribute to the overall parasitic capacitance. However, initially, only the first, smallest transistor may be considered as contributing to the overall parasitic capacitance. In this manner, the techniques may minimize the amount of parasitic capacitance that the driver of the voltage regulator needs to charge or discharge, initially, which allows the amount of current flowing through the first transistor to change relatively quickly for stabilizing the output voltage back to the constant output voltage level. The quick change in the amount of current flowing through the first transistor to the output of the voltage regulator may have the effect of reducing the transient response time.

In the techniques described in this disclosure, the driver may drive the gate of each of the transistors with separate current sources. In other words, the transistors are driven independently by the driver. For instance, if there are N transistors in the power stage of the voltage regulator, the driver of the voltage regulator may include N current sources that each drive the gate of a respective transistor of the N transistors. The driver may drive the gate of the first, smallest transistor of the N transistors directly with a first current source of the N current sources, and may drive the gates of the remaining N−1 transistors with a respective one of the remaining N−1 current sources.

Using the separate current sources to drive respective transistors may minimize the overshoot during the transient response time. For example, if a single current source that functions as a push-pull is used to drive the gates of the transistors, then the parasitic capacitance of the later stage transistors (e.g., the last, largest transistor) may discharge too slowly in the event that there is a reduction in the amount of current that needs to be delivered. The parasitic capacitance of the last, largest transistor discharging too slowly may result in the overshoot in the output voltage. Using a separate current source to drive each transistor may allow the transistors to charge and discharge in a timely fashion, thereby minimizing the overshoot.

In this way, the techniques described in this disclosure may reduce the transient response time, while minimizing the output voltage level overshoot during the transient response time. Moreover, to reduce the transient response time with the minimal overshoot, the techniques do not require any change to the quiescent current or any change to the capacitor connected to the output of the voltage regulator.

FIG. 1 is a conceptual block diagram illustrating an example portion of a voltage regulator that includes a driver and a power stage, in accordance with the techniques described in this disclosure. For instance, FIG. 1 illustrates a portion of voltage regulator 10. In some examples, voltage regulator 10 may be referred to as a linear regulator. As illustrated, voltage regulator 10 includes driver 12 and power stage 14. It should be understood that the separation between driver 12 and power stage 14 is conceptual and illustrated for ease of understanding.

Power stage 14 includes transistor M1-MN. Examples of transistors M1-MN include transistors such as metal-oxide-semiconductor field-effect-transistor (MOSFETs), gallium arsenide field-effect transistors (GaAsFETs), and Gallium Nitride field-effect transistors (GaNFETs). In some examples, transistors M1-MN may not be formed as bipolar junction transistors (BJTs), but may be formed as insulated-gate bipolar transistors (IGBTs). Transistors M1-MN may be both PMOS and NMOS power transistors.

Driver 12 may be formed with MOSFETs, IGBTs, GaAsFETs, GaNFETs, and BJTs. In other words, in some non-limiting examples, power stage 14 may be formed with limited types of transistors, but there may be no limit to the types of transistors that can be used to form driver 12. In some examples, there may no limit to the types of transistors that can be used for both driver 12 and power stage 14.

Voltage regulator 10 may be formed within an integrated circuit (IC) and may function to provide a voltage output at a constant output voltage level. Voltage regulators, such as voltage regulator 10, may be utilized in various applications. As one example, voltage regulator 10 may be utilized in automotive applications; however, voltage regulator 10 may be used in other applications as well, and the techniques described in this disclosure are not limited to automotive applications. In general, voltage regulator 10 may be used in any application where a constant, steady voltage level is needed.

For instance, the source node of the transistors M1-MN of power stage 14 may be connected to a power source such as a battery and the drain node of transistors M1-MN of power stage 14 may be connected to an output of voltage regulator 10. Transistors M1-MN may output the needed current to maintain the output voltage of voltage regulator 10 at a constant output voltage level. The constant output voltage level of voltage regulator 10 may be set by a reference voltage at an input of voltage regulator 10. As described in more detail, voltage regulator 10 may also receive a voltage proportional to the output voltage as a feedback voltage. Voltage regulator 10 may compare the reference voltage with the feedback voltage and adjust the currents flowing through transistors M1-MN such that the voltage output is equal to the constant output voltage level set by the reference voltage.

One of the capabilities of voltage regulator 10 may be to withstand changes (e.g., perturbations or transients) at the output or input of voltage regulator 10 from different sources. For example, parameters such as transient load regulation and transient line regulation define the ability of voltage regulator 10 to withstand changes at the output or input. Transient line regulation defines the ability of voltage regulator 10 to maintain the output voltage at the constant output voltage level even if there is a change in the source voltage. For instance, as described above, the source node of transistors M1-MN are connected to a power source such as a battery. If there is a sudden change in the voltage from the power source (i.e., a line transient), it may be possible that the change in the voltage from the power source causes the output voltage to deviate from the constant output voltage level. The ability of voltage regulator 10 to maintain the output voltage at the constant output voltage level is referred to the transient line regulation.

Transient load regulation refers to the ability of voltage regulator 10 to maintain the output voltage at the constant output voltage level due to a change (e.g., sudden change) in the load driven by voltage regulator 10. For example, if there is a sudden change in the impedance of the load driven by voltage regulator 10, the output voltage of voltage regulator 10 may deviate from the constant output voltage level. As an example, assume that voltage regulator 10 is outputting a voltage at a constant output voltage level of 10 volts (V), and the impedance of the load driven by voltage regulator 10 is 10 kOhms. In this example, voltage regulator 10 is outputting a current of 1 milliamps (mA). If the impedance of the load changed from 10 kOhms to 1 kOhms, voltage regulator 10 may need to output a current of 10 mA to maintain the output voltage at the constant output voltage level of 10 V.

The transient load regulation refers to the ability of voltage regulator 10 to adjust the current that needs to be outputted to maintain the output voltage at the constant output voltage level. One unit of measurement for the transient load regulation of voltage regulator 10 is the transient response time. The transient response time may be a measure of the amount of time voltage regulator 10 takes to adjust the current, due to a change in the load, to maintain the output voltage at the constant output voltage level. As described above, it may be preferable to minimize the transient response time.

One of the factors that effects the transient response time is the ability of transistors M1-MN in power stage 14 to allow the amount of current flowing through transistors M1-MN to change quickly. The ability of transistor M1-MN in power stage 14 to allow the amount of current flowing through to change quickly is a function of parasitic capacitance.

Parasitic capacitance is an intrinsic capacitance of transistors. As one example, parasitic capacitance refers to the capacitance between the gate and source nodes of a transistor (i.e., gate-source capacitance). The amount of parasitic capacitance of a transistor is a function of the size of the transistor. For instance, the parasitic capacitance of larger sized transistors is greater than the parasitic capacitance of smaller sized transistors. In this way, smaller sized transistors allow for the current to change more quickly than larger sized transistors.

In compensating for the change in the output impedance, there may be overshoot and undershoot in the output voltage. Voltage overshoot refers to the output voltage rising above the constant output voltage level before dropping back down. Voltage undershoot refers to the output voltage dropping below the constant output voltage level before rising back up. Voltage overshoot and undershoot may be considered as a form of dampened ringing, in which the output voltage level rises above the constant output voltage level and falls below the constant output voltage level, and overtime the overshoot and undershoot dampen until the output voltage stabilizes to the constant output voltage level. Voltage overshoot and undershoot should be minimized.

Relying solely on a small sized transistor to drive the output current of voltage regulator 10 may be undesirable because of drop off, where the size is too small to deliver the needed current. Although it may be possible to deliver the amount of needed current using a single large sized transistor, the transient response time may be too slow. For example, the parasitic capacitance of the large sized transistor may be too large to allow the current flowing through the transistor to change quickly.

Accordingly, in the techniques described in this disclosure, rather than utilizing a single small or large sized transistor, power stage 14 may include a plurality of different sized transistors M1-MN. In other words, the techniques may split a single transistor into a plurality of different sized transistors. Transistor M1-MN may be referred to together as a pass device. As described in more detail, by splitting a single transistor into a plurality of different sized transistors and connecting the gates of the transistors in the manner illustrated in FIG. 1, the techniques may minimize the initial parasitic capacitance that driver 12 charges or discharges allowing for fast adjustment of the current delivered (i.e., outputted) by voltage regulator 10. The parasitic capacitance that driver 12 charges or discharges may increase slowly over time because the parasitic capacitance of the larger sized transistors may not immediately contribute to the overall parasitic capacitance, but may be delayed in contributing to the overall parasitic capacitance from the resistor-capacitor (RC) time constant formed with the resistors connected to the gates and the larger parasitic capacitance due to the larger size of the transistors.

As described in more detail, by delaying the effects of the parasitic capacitance, the techniques may reduce the voltage undershoot during the transient response time. Also, as described in more detail, by driving the transistors with a respective current source (e.g., splitting the current source into a plurality of current sources in driver 12) may reduce the voltage overshoot during the transient response time.

In the techniques described in this disclosure, transistor M1 may be the smallest sized transistor from among the N transistors, transistor M2 may be the next smallest sized transistor, transistor M3 may be next smallest sized transistor, and so forth. Transistor MN may be the largest sized transistor.

Also, the gates of each of transistors M1-MN may be connected to the gate of another transistor through one or more resistors. For example, as illustrated, the gate of transistor M1 is connected to the gate of transistor M2 through resistor R1. The gate of transistor M2 is connected to the gate of transistor M3 through resistor R2, and so forth. The gate of transistor M(N−1) (not shown) is connected to the gate of transistor MN through resistor R(N−1). In this example, the gate of transistor M1 may be connected to the gate of transistor M3 through two resistors (i.e., resistor R1 and resistor R2).

The resistors R1-R(N−1) decouple each transistor M from successive transistors. For example, resistor R1 decouples transistor M2 from transistor M1. Resistors R2 and R1 decouple transistor M3 from transistor M1, and resistors R1+R2 . . . +R(N−1) decouple the largest sized transistor MN from the smallest sized transistor M1. By connecting gates of transistors M through respective resistors R1-R(N−1), the resistors R1-R(N−1) may delay or minimize the immediate effects of the parasitic capacitances of successive transistors M.

For example, in response to a change in the amount of current that voltage regulator 10 needs deliver (e.g., due to change in the load), driver 12 may adjust the amount of current flowing through transistor M1-MN. However, initially (i.e., immediately or very shortly after there is a change in the load), to adjust the current flowing to the output of voltage regulator 10, driver 12 may need to charge or discharge the parasitic capacitance of transistor M1, and only charge or discharge the parasitic capacitance of transistor M1, because the parasitic capacitances from the other transistors (e.g., transistor M2-MN) do not contribute to the overall parasitic capacitance of power stage 14 due to the decoupling of the transistors via resistors R1-R(N−1). Furthermore, because transistor M1 is the smallest sized transistor, the parasitic capacitance of transistor M1 is the smallest, allowing for the current flowing through transistor M1 to change relatively quickly for stabilizing the output voltage of voltage regulator 10 to the constant output voltage level.

Over time, the parasitic capacitance of transistor M2 may contribute to the overall parasitic capacitance of power stage 14, but the contribution of transistors M3 through MN may be delayed or may be minimal to the overall parasitic capacitance. A short time after, the parasitic capacitance of transistor M3 may contribute to the overall parasitic capacitance of power stage 14, and so forth until the parasitic capacitance of transistor MN contributes to the overall parasitic capacitance of power stage 14.

In this way, the initial parasitic capacitance of power stage 14 is minimized to that of transistor M1, which is also the smallest sized transistor allowing for fast adjustment of the current delivered by voltage regulator 10 for stabilizing the output voltage to the constant output voltage level. Then, the parasitic capacitance from additional transistors successively contribute to the overall parasitic capacitance of power stage 14, which reduces the voltage overshoot and voltage undershoot allowing for the output voltage to stabilize to the constant output voltage level without excessive fluctuations in the output voltage. Accordingly, the configuration of transistors and resistors in power stage 14 may allow for fast transient response time with reduced voltage overshoot and undershoot.

In other words, to improve the transient behavior (e.g., improve transient load regulation), driver 12 may "see" the smallest possible capacitance (e.g., driver 12 may need to charge or discharge the smallest capacitance because transistor M1 is the smallest sized transistor). In case of a load jump (e.g., a change in the impedance of the load connected to voltage regulator 10), driver 12 may be able to drive the pass-device (i.e., power stage 14) faster because initially only the parasitic capacitance from the smallest sized transistor (i.e., transistor M1) will be "seen" by driver 12.

There may be one requirement on the size of transistor M1. Transistor M1 should be sized large enough that transistor M1 is able to deliver sufficient current to the output of voltage regulator 10 until transistor M2 begins to deliver current. In other words, in response to a change in the amount of current needed to maintain the output of voltage regulator 10 at the constant output voltage level, a first transistor (e.g., transistor M1) is configured to deliver the amount of current needed until an amount of current flowing through a second transistor (e.g., transistor M2) changes.

For example, because transistor M2 is larger than transistor M1 (and hence has a larger parasitic capacitance), it may take a longer time for the current flowing through transistor M2 to change (i.e., there may be a delay in when the amount of current flowing through transistor M2 changes relative to the time when the amount of current flowing through transistor M1 changes). If transistor M1 is too small to deliver the needed current before the amount of current flowing through transistor M2 starts changing, there may be a drop in the current outputted by voltage regulator 10 causing a drop in the output voltage level. Accordingly, by ensuring that transistor M1 is large enough to deliver the current until transistor M2 begins to deliver the current, the techniques may ensure that initially there is not an excessive drop in the output voltage level.

In addition to providing techniques for a fast transient response time with reduced voltage overshoot and voltage undershoot, the techniques may further minimize the voltage overshoot. As described above, driver 12 drives transistors M1-MN of power stage 14. In the techniques described in this disclosure, driver 12 may include a plurality of separate current sources that each drive the gate of a respective one of transistors M1-MN. In other words, driver 12 may independently drive the gates of the transistors M1-MN.

As illustrated, driver 12 includes current sources Ip,1 to Ip,N. Each of the current sources Ip,1 to Ip,N may drive (i.e., output current to) a respective one of transistors M1-MN. For instance, current source Ip,1 outputs directly to the gate of transistor M1, current source Ip,2 outputs directly to the gate of transistor M2, and so on with current source Ip,N outputting directly to the gate of transistor MN.

Additionally, for any one of transistors M1-MN, current sources other than the respective current source may drive the gate via one or more resistors. As one example, the gate of transistor M1 is connected to current source Ip,1, but is also connected to current source Ip,2 through resistor R1, to Ip,3 through resistors R1 and R2, and so on. For instance, the gate of transistor M1 is connected to current source Ip,N through resistors R(N−1), R(N−2), and all the way through R1. The other transistors may be similarly connected to the current sources.

FIG. 1 illustrates node 16 within driver 12. Node 16 is the node where all of the Ip currents (i.e., Ip,1 to Ip,N) meet flow to ground as current In. For instance, currents Ip,1 to Ip,N are labeled as such because their current flows from the positive (p) voltage node of the power supply, and the current In is labeled as such because its current flows to the negative (n) voltage node of the power supply (e.g., the ground node). Accordingly, In represents the total current of Ip,1 to Ip,N. Therefore, In equals Ip,1+Ip,2+Ip,3+ . . . +Ip,N.

By splitting the Ip current into Ip,1 to Ip,N, the techniques may ensure that voltage overshoot at the output of voltage regulator 10 is further minimized. For example, in some other techniques, rather than utilizing multiple Ip currents, these other techniques utilize a single Ip current that works in a push-pull fashion with the In current. However, in these other techniques, the parasitic capacitance of the later stage transistors may discharge too slowly causing an overshoot in case there is a reduction in the amount of current that needs to be delivered.

For example, voltage regulator 10 may deliver current to a plurality of loads. If one of the loads becomes disconnected (in what is referred to as a load dump), then the output voltage of voltage regulator 10 may suddenly spike. As an example, assume that the output voltage of voltage regulator 10 is 10V, and voltage regulator 10 is driving five loads in parallel, each with an impedance of 1 kOhm. In this example, each load is sinking 10 mA of current, which means that voltage regulator 10 is delivering 50 mA of current. Assume that three of the five loads become disconnected (i.e., there is a load dump of three loads). In this case, to keep the output voltage constant at 10 V, voltage regulator 10 may need to deliver 20 mA of current. However, voltage regulator 10 may not be able to immediately adjust the delivered current from 50 mA to 20 mA. Accordingly, in this example, 50 mA may flow through the two remaining 1 kOhm loads (i.e., 25 mA through each 1 kOhm load), causing the output voltage to spike to 25V from 10V, and causing an overshoot on the output voltage of voltage regulator 10.

If the parasitic capacitance of the later stage larger sized transistors is not discharged in a timely fashion, the output voltage of voltage regulator 10 may overshoot even if the transistors of power stage 14 are split in the manner illustrated in FIG. 1. For instance, in the other techniques that use only one Ip current, the time it takes the parasitic capacitance of transistor MN to discharge is based on the sum of the resistance of resistors R1-R(N−1) multiplied by the parasitic capacitance of transistor MN.

However, in the techniques described in this disclosure, the time it takes the parasitic capacitance of transistor MN to discharge is based predominantly on the parasitic capacitance of transistor MN, which may be less than the discharge rate of the single Ip current technique that is based on the sum of the resistance of resistors R1-R(N−1) multiplied by the parasitic capacitance of transistor MN. The reason the discharge rate of transistor MN is based predominantly on the parasitic capacitance of transistor MN is because there is a current source that directly drives the gate of transistor MN, in addition to the other current sources that drive the gate of transistor MN through resistors R1-R(N−1). In this way, the current sources Ip,1 to Ip,N timely discharge a parasitic capacitance of a later stage transistor (e.g., transistor MN) in response to a reduction in a resistance of one or more loads (e.g., a load dump) driven by voltage regulator 10 to minimize a voltage overshoot in the output of voltage regulator 10.

For instance, transistor MN is driven directly by current Ip,N, in addition to the other current sources through respective resistors. The second to most largest transistor (i.e., transistor M(N−1)) is driven directly by current Ip,N−1, in addition to the other current sources through respective resistors. In this manner, driver 12 may ensure that the parasitic capacitances of the later stage transistors (e.g., the larger sized transistors) are discharged in a timely fashion to further minimize the voltage overshoot.

In this manner, in the techniques described in this disclosure, in response to a change in the amount of current needed to maintain the output of voltage regulator 10 at a constant voltage level, a first current source (e.g., Ip,1) and a second current source (e.g., Ip,2) may be configured to initially charge or discharge only a parasitic capacitance of a first transistor (e.g., transistor M1). For instance, in response to a change in the amount of current needed to maintain the output of voltage regulator 10 at the constant voltage level, an amount of current flowing through a first transistor (e.g., transistor M1) changes more quickly than an amount of current flowing through a second transistor (e.g., transistor M2) based on a parasitic capacitance of the first transistor charging or discharging more quickly than a parasitic capacitance of the second transistor.

In some examples, the Ip currents may be proportional to the sizes of respective transistors. For example, Ip,1 is proportional to the size of transistor M1. Ip,2 is proportional to the size of transistor M2, and so on. This means that Ip,N is greater than Ip,N−1, which is greater than Ip,N−2, and so forth, with Ip,2 being greater than Ip,1.

For example, assume that there are two transistors M (M1 and M2) in power stage 14. This means that there are two current sources Ip (Ip,1 and Ip,2). Therefore, Ip,1 plus Ip,2 equals In (i.e., Ip,1+Ip,2=In). Also, the variable Wpass1 defines the size of transistor M1, and the variable Wpass2 defines the size of transistor M2. In some examples, the ratio of Ip,1 to Ip,2 equals the ratio of Wpass1 to Wpass2 (i.e., Ip,1/Ip,2=Wpass1/Wpass2). Therefore, based on available transistor sizes and selected In current, it may be possible to determine the value of Ip,1 and Ip,2.

As one example, assume that Wpass1 equals 10,000 micrometers (um) and Wpass2 equals 20,000 um. In this example, in case of a load jump (i.e., a sudden increase in the load at the output of voltage regulator 10), driver 12 may initially need to charge only ⅓ of the gate-source capacitance (e.g., parasitic capacitance) of the pass element (i.e., power stage 14). As a consequence, the voltage undershoot may be greatly reduced.

It should be understood that the previous example of there being only two transistors M1 and M2, and the ratio of Ip,1 to Ip,2 equals the ratio of Wpass1 to Wpass2 is provided solely of example purposes and should not be considered limiting. In other examples, there may be more than two transistors M1 and M2, and the ratio of Ip,1 to Ip,2 does not need to equal the ratio of Wpass1 to Wpass2 in every example. Also, the values of Wpass1 and Wpass2 equaling 10,000 um and 20,000 um, respectively, is provided for illustration purposes only and should not be considered limiting.

As described above, the techniques described in this disclosure provide for fast transient response time, while minimizing overshoot and undershoot. In some examples, the techniques described in this disclosure provide for the fast transient response time with minimal voltage overshoot and undershoot without needing to increase a quiescent current of voltage regulator 10 or a size of a capacitor connected to the output of voltage regulator 10.

Quiescent current, as described above, refers to the current that voltage regulator 10 consumes when voltage regulator 10 is not delivering current. In some examples, Ip,1 to Ip,N currents and the In current are part of the quiescent current of voltage regulator 10. As an example, voltage regulator 10 includes a bias current that flows through one or more transistors used to compare the feedback voltage with the reference voltage. Driver 12 may derive the Ip,1 to Ip,N and In currents from the bias current, and the bias current plus the Ip,1 to Ip,N and In currents may all be considered as part of the quiescent current of voltage regulator 10.

In some other techniques, such as those in which the power stage does not include multiple transistors and/or where the driver does not include multiple current sources, one way to reduce transient response time is to increase the quiescent current. For example, with a higher quiescent current level, it may be possible to charge or discharge the parasitic capacitance of a transistor in the power stage. For instance, as described above, some other techniques did not split a transistor into multiple transistors in the manner illustrated in FIG. 1. For these other techniques, by increasing the quiescent current level (e.g., increasing from 5 uA to 10 uA), it is possible to charge and discharge the transistor more quickly.

However, increasing the quiescent current is undesirable because the increased quiescent current may drain the battery that powers voltage regulator 10 more quickly. In other words, high current efficiency is needed to maximize the lifetime of the battery that is supplying voltage regulator 10 with power.

In these other techniques that increase the quiescent current, there is a tradeoff between the amount of deviation in the output voltage and a desire to keep the quiescent current low. In the techniques described in this disclosure, the transient response time is kept relatively fast with minimal voltage overshoot and undershoot. Additionally, no increase in the quiescent current is needed to achieve the fast transient response time with minimal voltage overshoot and undershoot.

Some other techniques propose, in addition to or instead of increasing the quiescent current, to increase a size of a capacitor connected to an output of voltage regulator 10. The output of voltage regulator 10 may be connected to a capacitor. The capacitor may function as a tank to provide the needed current until the feedback loop of voltage regulator 10 is able to react (e.g., the feedback voltage causes an adjustment in the current flowing to the load).

The length of time the capacitor can provide the needed current is a function of the amount of capacitance that the capacitor provides. For instance, a capacitor with higher capacitance can provided the needed current longer than a capacitor with lower capacitance. To make a system more tolerable to a slower transient response time, it may be possible to connect a capacitor with a relatively large capacitance so that the capacitor can deliver the needed current for a longer period of time.

However, capacitors with higher capacitance are generally larger in size than capacitors with lower capacitance and tend to cost more as well. Having a larger sized capacitor may require additional area on a printed circuit board (PCB) that includes voltage regulator 10. Also, having the larger size capacitor increases cost.

In the techniques described in disclosure, the transient response time of voltage regulator 10 may be relatively fast with minimal voltage overshoot and undershoot. Also, to achieve such fast transient response time with minimal voltage overshoot and undershoot, the techniques may not require any changes to the capacitor (e.g., an increase in capacitance) connected to the output of voltage regulator 10.

Figure 2:
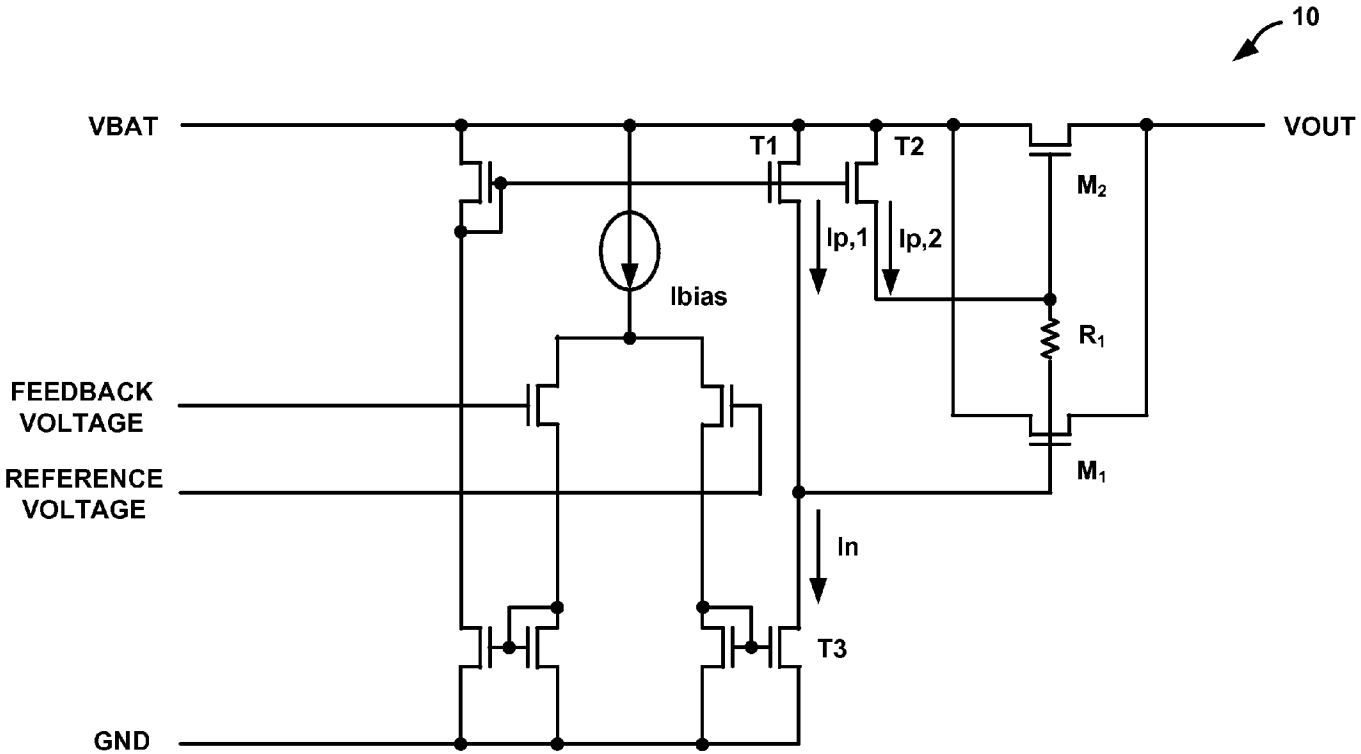
FIG. 2 is a block diagram illustrating a more detailed example of a voltage regulator, in accordance with the techniques described in this disclosure.

FIG. 2 is a block diagram illustrating a more detailed example of a voltage regulator, in accordance with the techniques described in this disclosure. For ease of illustration, voltage regulator 10 is illustrated with two transistors M1 and M2 whose gates are decoupled via resistor R1. The two transistor M1 and M2 are driven by currents Ip,1 and Ip,2. Voltage regulator 10 may include more than two transistors and more than two Ip currents in other examples such as the one illustrated in FIG. 1.

As illustrated in FIG. 2, voltage regulator 10 receives as input a reference voltage and a feedback voltage. The reference voltage may be generated by any reference voltage source coupled to voltage regulator 10. In general, the reference voltage source that generates the reference voltage may not be able to ensure that the voltage level of the reference voltage remains constant over a range of current that needs to be delivered by the reference voltage source. As described above, voltage regulator 10 may be configured to output a voltage whose voltage level is generally constant over a range of currents levels that need to be delivered. The reference voltage determines the constant output voltage level of voltage regulator 10 (e.g., the same voltage or a proportional voltage).

As illustrated in FIG. 2, voltage regulator 10 also receives as input a feedback voltage. The feedback voltage may be proportional to the output voltage (i.e., proportional to the voltage at VOUT). For instance, VOUT of voltage regulator 10 may be connected to a voltage divider. The feedback voltage may be an output of the voltage divider (i.e., the feedback voltage is proportional to the VOUT voltage based on the voltage divider).

A differential pair of voltage regulator 10 receives the reference voltage and the feedback voltage, as illustrated in FIG. 2. The differential pair of voltage regulator 10 compares the reference voltage and the feedback voltage. The current flowing through transistors M1 and M2 changes to stabilize the output voltage to the constant output voltage level, and the Ip,1 and Ip,2 currents control the rate at which transistors M1 and M2 are able to change the current flowing through transistors M1 and M2 by charging or discharging the parasitic capacitance as described above.

In this manner, voltage regulator 10 includes a feedback loop via the feedback voltage to stabilize the output voltage to the constant output voltage level. For instance, if the output voltage deviates from the constant output voltage level, the difference between the feedback voltage and the reference voltage changes, and the current flowing through transistors M1 and M2 changes to compensate for the difference in the feedback voltage and the reference voltage. The time it takes voltage regulator 10 to stabilize the output voltage to the constant output voltage level is referred to as the transient response time.

For example, the source node of transistors M1 and M2 may be connected to the power source (e.g., a battery with VBAT voltage) and the drain node of transistors M1 and M2 may be connected to VOUT. Transistor M1 and M2 may sink current from the battery, and the amount of current that transistors M1 and M2 sink may be based on the amount of current that needs to be delivered to keep the output voltage at the constant output voltage level. Furthermore, although not illustrated, VOUT of voltage regulator 10 may be connected to a capacitor that functions as a tank for delivering the needed current during the transient response time.

As described above, voltage regulator 10 includes a differential pair that compares the feedback voltage and the reference voltage. The differential pair is driven by the Ibias current. The In current and the Ip,1 and Ip,2 currents are mirrored from the Ibias current. In this example, the Ibias current, the transistors of the differential pair, and the transistors that mirror the Ibias current may be formed as part of an operational transconductance amplifier (OTA).

In the example illustrated in FIG. 2, transistors T1, T2, and T3 form an example of driver 12. Transistors M1 and M2 and resistor R1 form an example of power stage 14. As one example, resistor R1 may be 100 kOhm resistor.

In the example illustrated in FIG. 2, the OTA and driver 12 are formed with MOSFET transistors. However, the techniques described in this disclosure are not so limited. In some examples, the OTA and driver 12 may be formed with BJT transistors.

Figure 3:
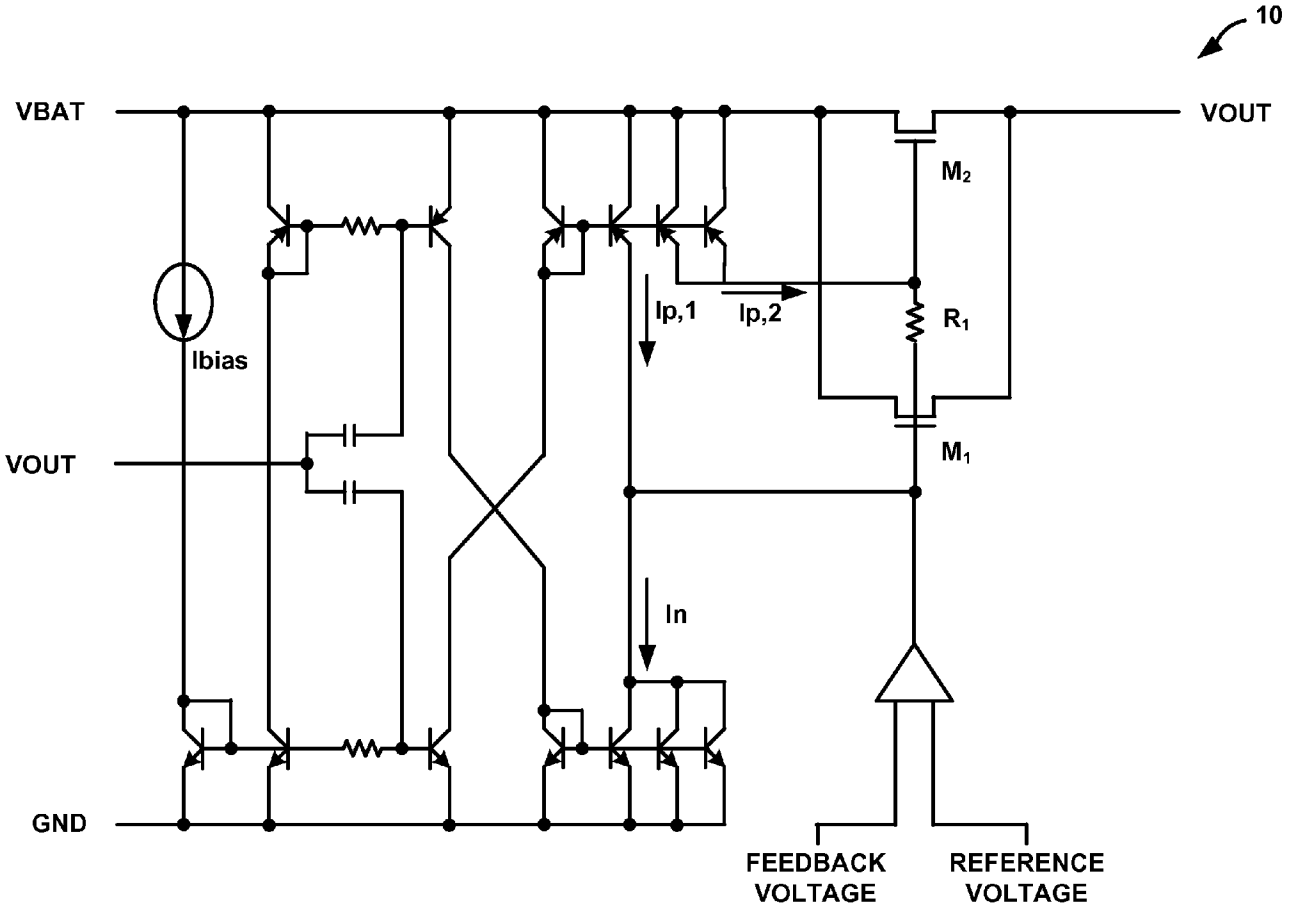
FIG. 3 is a block diagram illustrating another more detailed example of a voltage regulator, in accordance with the techniques described in this disclosure.

FIG. 3 is a block diagram illustrating another more detailed example of a voltage regulator, in accordance with the techniques described in this disclosure. For example, FIG. 3 illustrates an example of voltage regulator 10 where the OTA and driver 12 are formed with BJT transistors.

In the example of voltage regulator 10, illustrated in FIG. 3, driver 12 is also part of a feedback loop that includes a differentiator to ensure faster loop response. For example, a voltage regulator similar to that illustrated in FIG. 3 was described in U.S. Patent Publication No. US 2011/0291627 A1, filed May 13, 2011, the entire contents of which are incorporated by reference herein. However, the voltage regulator described in US 2011/029167 A1 did not include multiple Ip currents in the driver and split transistors with gates connected via resistors in the power stage, in accordance with the techniques described in this disclosure. In other words, FIG. 3 illustrates that the techniques described in this disclosure may be utilized with other pre-existing voltage regulators in that pre-existing voltage regulators may be modified to include multiple Ip currents in the driver that each drive respective transistors in the power stage, where the gates of the transistors are connected to one another via one or more resistors.

Similar to FIG. 2, FIG. 3 illustrates an example of voltage regulator 10 in which power stage 14 includes two MOSFET transistors M1 and M2 whose gates are connected with a resistor R1. Resistor R1 may be a 100 kOhm resistor. The BJT transistors that form the In current and the Ip,1 and Ip,2 currents form driver 12. Also, unlike FIG. 2, in the example of FIG. 3, the reference voltage and the feedback voltage are compared by an OTA whose output is feed to the gate of transistor M1 and through resistor R1 to the gate of transistor M2.

In this way, FIG. 3 illustrates an example of voltage regulator 10 with two feedback loops. The first feedback loop receives VOUT as an input and differentiates the VOUT output via two capacitors that feed into the driver of voltage regulator 10, as illustrated in FIG. 3. This first feedback loop may provide a first way to reduce the transient response time, such as for addressing transient line regulation. The second feedback loop receives the feedback voltage as an input that is compared to the reference voltage for stabilizing VOUT to the constant output voltage level. For instance, this second feedback loop changes the amount of current flowing through transistors M1 and M2, and currents Ip,1 and Ip,2 control the rate at which the current flowing through transistors M1 and M2 changes by charging or discharging the parasitic capacitance of transistors M1 and M2.

Figure 4:
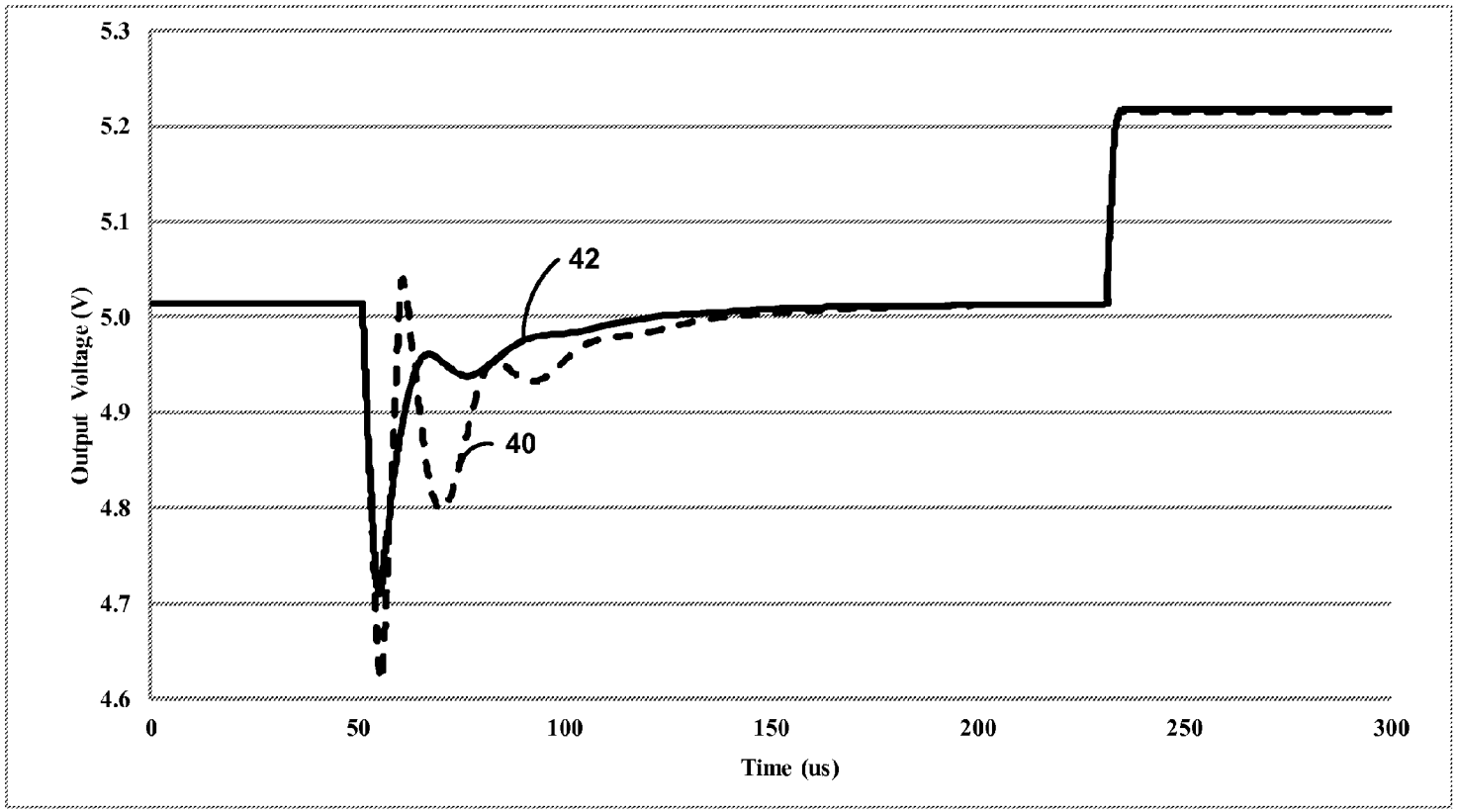
FIG. 4 is a graphical diagram illustrating an output voltage of a voltage regulator over time in response to a change in an amount of current that needs to be delivered by the voltage regulator.

FIG. 4 is a graphical diagram illustrating an output voltage of a voltage regulator over time in response to a change in an amount of current that needs to be delivered by the voltage regulator. In the example illustrated in FIG. 4, line 40 illustrates the output voltage over time with techniques other than those described in this disclosure (e.g., techniques in which a current in the driver of the voltage regulator is not split into multiple current and in which a transistor in the power stage of the voltage regulator is not split into multiple transistors with gates connected via one or more resistors). Line 42 illustrates the output voltage over time utilizing techniques described in this disclosure (e.g., techniques in which driver 12 includes multiple Ip currents that each drive respective transistors M1-MN in power stage 14, where the gates of transistors M1-MN are connected to one another via resistors R1-R(N−1)).

FIG. 4 illustrates the behavior of the output voltage over time in an example where there is a load jump. For example, the voltage regulator (i.e., voltage regulator 10 for line 42 and some other voltage regulator for line 40) may initially be driving a load or loads that require 1 uA of current. Then, there may be load jump (i.e., an increase in the impedance of the load or loads that the voltage regulator is driving) so that 100 mA of current is needed to keep the output of the voltage regulator at the constant output voltage level. The quiescent current of the voltage regulator that generates line 40 or line 42 may be 5 uA.

As illustrated in FIG. 4, the ringing of line 40 is much greater than the ringing of line 42. For example, the output voltage for the other techniques undershoots and overshoots (as illustrated by line 40) much more than the output voltage in accordance with the techniques described in this disclosure (as illustrated by line 42). Accordingly, FIG. 4 illustrates potential advantages that may be realized by utilizing the techniques described in this disclosure such as a fast transient response time with minimal voltage overshoot and voltage undershoot where the quiescent current does not need to be increased or the capacitance of the capacitor connected to the output of the voltage regulator does not need to be increased.

Figure 5:
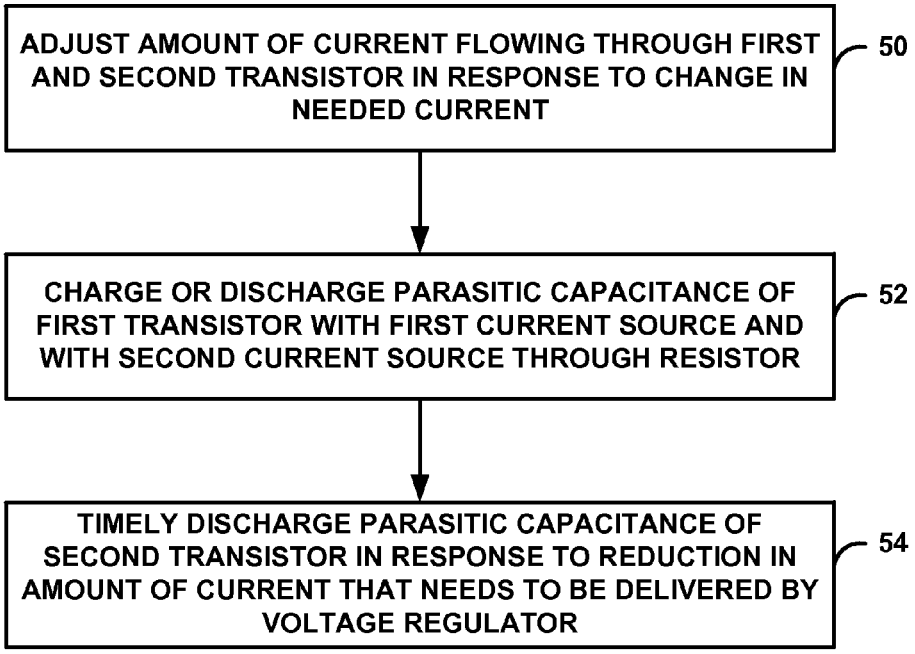
FIG. 5 is a flowchart illustrating an example technique, in accordance with this disclosure.

FIG. 5 is a flowchart illustrating an example technique, in accordance with this disclosure. For ease of illustration, reference is made to FIG. 1. As illustrated in FIG. 5, in response to a change in an amount of current that needs to be delivered by voltage regulator 10, voltage regulator 10 may adjust an amount of current flowing through a first transistor (e.g., M1) and a second transistor (e.g., M2) of voltage regulator 10 to maintain an output of voltage regulator 10 at a constant output voltage level (50). In the techniques described in this disclosure, the first transistor and the second transistor are connected to a power source (e.g., battery) and to the output of voltage regulator 10 (i.e., source node to VBAT and drain node to VOUT). Also, a resistor R1 connects a gate of the first transistor to a gate of the second transistor.

Although the techniques described in FIG. 5 are described with adjusting current through two transistors, in other examples voltage regulator 10 may include a plurality of transistors. For example, as illustrated in FIG. 1, voltage regulator 10 includes a plurality of transistors that are each connected to the power source and the output of voltage regulator 10 and deliver the amount of current needed to maintain the output of voltage regulator 10 at the constant output voltage level. Also, voltage regulator 10 includes a plurality of resistors, where a gate of any of the transistors is connected to a gate of any of the other transistor through one or more of the resistors. Furthermore, voltage regulator 10 includes a plurality of current sources (e.g., Ip,1 to Ip,N) to drive gates of respective transistors and gates of the other transistors through one or more of the resistors.

The first current source may charge or discharge the parasitic capacitance of the first transistor with the first current source and the second current source may charge or discharge the parasitic capacitance of the first transistor through the resistor that connects the gate of the first transistor to the gate of the second transistor (52). For example, Ip,1 may charge or discharge the parasitic capacitance of transistor M1 and Ip,2 may charge or discharge the parasitic capacitance of transistor M2 through resistor R1. In some examples, Ip,1 and Ip,2 may initially charge or discharge only a parasitic capacitance of transistor M1 in response to a change in the amount of current that needs to be delivered by voltage regulator 10. In some examples, for adjusting the amount of current flowing through the first transistor and the second transistor, an amount of current flowing through the first transistor may change more quickly than an amount of current flowing through the second transistor based on a parasitic capacitance of the first transistor charging or discharging more quickly than a parasitic capacitance of the second transistor.

Voltage regulator 10 may also timely discharge the parasitic capacitance of the second transistor in response to a reduction in the amount of current that needs to be delivered by voltage regulator 10 (54). For instance, as described above, if there is a load dump causing a reduction in the amount of current needed to be delivered there may an overshoot in the output voltage. With the second current source driving the gate of the second transistor, it may be possible to charge or discharge the second transistor in a timely fashion (e.g., quickly) so that the output voltage does not overshoot.

The techniques of this disclosure may be implemented in a wide variety of devices or apparatuses, with an integrated circuit (IC) or a set of ICs (i.e., a chip set). Various components, modules, or units are described in this disclosure to emphasize functional aspects of devices configured to perform the disclosed techniques, but do not necessarily require realization by different hardware units. Rather, various units may be combined in a hardware unit or provided by a collection of interoperative hardware units.

Various examples have been described. These and other examples are within the scope of the following claims.

The invention claimed is:

1. A voltage regulator comprising:

a first transistor and a second transistor, wherein the first transistor and the second transistor are connected to a power source of the voltage regulator and an output of the voltage regulator, and wherein the first transistor and the second transistor deliver an amount of current needed to maintain the output of the voltage regulator at a constant output voltage level;

a resistor that connects a gate of the first transistor to a gate of the second transistor; and a first current source and a second current source, wherein the first current source is configured to drive the gate of the first transistor and the gate of the second transistor through the resistor, and wherein the second current source is configured to drive the gate of the second transistor and the gate of the first transistor through the resistor.

2. The voltage regulator of claim 1, further comprising:

a plurality of additional transistors that are each connected to the power source of the voltage regulator and the output of the voltage regulator and deliver the amount of current needed to maintain the output of the voltage regulator at the constant output voltage level;

a plurality of additional resistors, wherein a gate of any of the additional transistors is connected to a gate of any of the other additional transistor and the first and second transistors through one or more of the plurality of additional resistors; and a plurality of additional current sources configured to drive gates of respective additional transistors and gates of the other additional transistors through one or more of the plurality of additional resistors.

3. The voltage regulator of claim 1, wherein, in response to a change in the amount of current needed to maintain the output of the voltage regulator at the constant voltage level, the first and second current source are configured to initially charge or discharge only a parasitic capacitance of the first transistor.

4. The voltage regulator of claim 1, wherein, in response to a change in the amount of current needed to maintain the output of the voltage regulator at the constant voltage level, an amount of current flowing through the first transistor changes more quickly than an amount of current flowing through the second transistor based on a parasitic capacitance of the first transistor charging or discharging more quickly than a parasitic capacitance of the second transistor.

5. The voltage regulator of claim 1, wherein, in response to a change in the amount of current needed to maintain the output of the voltage regulator at the constant output voltage level, the first transistor is configured to deliver the amount of current needed until an amount of current flowing through the second transistor changes.

6. The voltage regulator of claim 1, wherein the first transistor is smaller than the second transistor.

7. The voltage regulator of claim 1, wherein a current level of the first current source is proportional to a size of the first transistor, and wherein a current level of the current source is proportional to a size of the second transistor.

8. The voltage regulator of claim 1, wherein the second current source is configured to timely discharge a parasitic capacitance of the second transistor in response to a reduction in an amount of current that needs to be delivered by the voltage regulator to minimize a voltage overshoot in the output of the voltage regulator.

9. A method comprising:

in response to a change in an amount of current that needs to be delivered by a voltage regulator, adjusting an amount of current flowing through a first transistor and a second transistor of the voltage regulator to maintain an output of the voltage regulator at a constant output voltage level, wherein the first transistor and second transistor are connected to a power source of the voltage regulator and to the output of the voltage regulator, and wherein a resistor of the voltage regulator connects a gate of the first transistor to a gate of the second transistor; and in response to the change in the amount of current that needs to be delivered by the voltage regulator, charging or discharging a parasitic capacitance of the first transistor with a first current source connected to the gate of the first transistor and a second current source connected to the gate of the first transistor through the resistor.

10. The method of claim 9, wherein charging or discharging the parasitic capacitance comprises charging or discharging only the parasitic capacitance of the first transistor in response to the change in the amount of current that needs to be delivered by the voltage regulator.

11. The method of claim 9, wherein adjusting the amount of current flowing through the first transistor and the second transistor of the voltage regulator comprises adjusting an amount of current flowing through the first transistor more quickly than an amount of current flowing through the second transistor based on the parasitic capacitance of the first transistor charging or discharging more quickly than a parasitic capacitance of the second transistor.

12. The method of claim 9, wherein adjusting the amount of current flowing through the first transistor and the second transistor of the voltage regulator comprises delivering the current with the first transistor until an amount of current flowing through the second transistor changes.

13. The method of claim 9, wherein the first transistor is smaller than the second transistor.

14. The method of claim 9, wherein a current level of the first current source is proportional to a size of the first transistor, and wherein a current level of the second current source is proportional to a size of the second transistor.

15. The method of claim 9, further comprising:

timely discharging a parasitic capacitance of the second transistor in response to a reduction in the amount of current that needs to be delivered by the voltage regulator to minimize a voltage overshoot in the output of the voltage regulator.

16. A voltage regulator comprising:

in response to a change in an amount of current that needs to be delivered by the voltage regulator, means for adjusting an amount of current flowing through a first transistor and a second transistor of the voltage regulator to maintain an output of the voltage regulator at a constant output voltage level, wherein the first transistor and second transistor are connected to a power source of the voltage regulator and to the output of the voltage regulator, and wherein a resistor of the voltage regulator connects a gate of the first transistor to a gate of the second transistor; and in response to the change in the amount of current that needs to be delivered by the voltage regulator, means for charging or discharging a parasitic capacitance of the first transistor with a first current source connected to the gate of the first transistor and a second current source connected to the gate of the first transistor through the resistor.

17. The voltage regulator of claim 16, wherein the means for charging or discharging the parasitic capacitance comprises means for charging or discharging only the parasitic capacitance of the first transistor in response to the change in the amount of current that needs to be delivered by the voltage regulator.

18. The voltage regulator of claim 16, wherein the means for adjusting the amount of current flowing through the first transistor and the second transistor of the voltage regulator comprises means for adjusting an amount of current flowing through the first transistor more quickly than an amount of current flowing through the second transistor based on the parasitic capacitance of the first transistor charging or discharging more quickly than a parasitic capacitance of the second transistor.

19. The voltage regulator of claim 16, wherein the first transistor is smaller than the second transistor.

20. The voltage regulator of claim 16, further comprising:

means for timely discharging a parasitic capacitance of the second transistor in response to a reduction in the amount of current that needs to be delivered by the voltage regulator to minimize a voltage overshoot in the output of the voltage regulator.

* * * * *